US006619774B1

(12) United States Patent
Kawai et al.

(10) Patent No.: US 6,619,774 B1
(45) Date of Patent: Sep. 16, 2003

(54) IMAGE FORMING DEVICE OPERABLE BY DIFFERENT POWER SOURCES

(75) Inventors: Takamitsu Kawai, Nagoya (JP); Naoki Oda, Kasugai (JP); Yuji Koga, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/188,147

(22) Filed: Nov. 9, 1998

(30) Foreign Application Priority Data

Nov. 11, 1997 (JP) ..... 9-308327
Nov. 13, 1997 (JP) ..... 9-311965
Jul. 8, 1998 (JP) ..... 10-192770

(51) Int. Cl.[7] ..... B41J 3/00; B41J 29/393
(52) U.S. Cl. ..... 347/2; 347/19
(58) Field of Search ..... 702/63; 712/300, 712/320, 340; 340/455, 636, 693.2; 320/114, 121, 132; 713/300, 310, 320, 323, 340; 400/88; 361/189; 347/2, 5, 19, 109, 108

(56) References Cited

U.S. PATENT DOCUMENTS 5,348,407 A * 9/1994 Hock et al. ..... 400/711
5,520,470 A * 5/1996 Willett ..... 400/88
5,531,431 A * 7/1996 Saito et al. ..... 271/4.01
5,677,721 A * 10/1997 Suzuki et al. ..... 347/190
5,831,656 A * 11/1998 Chosa ..... 347/108
5,857,065 A * 1/1999 Suzuki ..... 358/1.15

FOREIGN PATENT DOCUMENTS

JP 405177904 A * 7/1993 ..... B41J/029/16

* cited by examiner

*Primary Examiner*—Thinh Nguyen
*Assistant Examiner*—Julian D. Huffman
(74) *Attorney, Agent, or Firm*—Oliff & Berridge, PLC

(57) ABSTRACT

An ink jet printer connected to a personal computer and normally driven by a PC battery accommodated in the personal computer. The ink jet printer detachably accommodates therein an auxiliary battery. The printer has a control portion and a driving portion for moving a print head. If a voltage level of the PC battery becomes less than a threshold voltage during printing operation, the electrical connection between the PC battery and the control portion is maintained, whereas a power source to the driving portion is switched from the PC battery to the auxiliary battery. After the printing operation is completed, a power source to the control portion is switched from the PC battery to the auxiliary battery.

22 Claims, 11 Drawing Sheets

IMAGE FORMING DEVICE OPERABLE BY DIFFERENT POWER SOURCES

BACKGROUND OF THE INVENTION

The present invention relates to an image forming device, and more particularly, to the device battery powered, the battery being provided in an external device such as a personal computer.

An ink jet printer ejects ink droplets onto an image recording medium such as a sheet to form an inked image on the sheet. For example, a commonly assigned co-pending U.S. Pat. No. 6,286,934 filed Sep. 24, 1998 discloses an ink jet printer provided with a PCMCIA card electrically connected to a control circuit board through a connection cable. By inserting the PCMCIA card into a PCMCIA card slot of a portable type personal computer (hereinafter simply referred to as "computer"), an electrical power can be supplied from a battery of the computer to the printer through the connection cable. AC power source is not required in such an ink jet printer. Therefore, the printer can be carried, together with the computer, to the outdoor where no AC power source is provided to perform printing operation.

However, the battery of the computer has a relatively small electrical power capacity, and therefore, only a limited amount of the electrical power can be supplied to the ink jet printer. Accordingly, if a large amount of printing is performed, electrical power in the battery of the computer may be largely consumed. Further, if the computer is battery powered, and if the large amount of printing is performed by the ink jet printer, the electrical power consumption is further promoted, and a system-down of the computer may occur.

SUMMARY OF THE INVENTION

It is therefore an object of the present invention to overcome the above described problem and to provide an improved image forming device capable of receiving electrical power from an external device such as a personal computer and capable of restraining a system-down of the external device due to electrical power consumption of the image forming device.

This and other objects of the present invention will be attained by an image forming device for use in combination with an external device, the image forming device including a printing unit, an auxiliary power source unit, detecting means and means for stopping a power supply. The printing unit normally performs an image forming operation by a primary power source installed in the external device. The auxiliary power source unit is connectable to the printing unit for supplying power to the printing unit instead of the primary power source. The detecting means detects a power supply condition of at least one of the primary power source and the auxiliary power source. The stopping means is adapted for stopping power supply from the primary power source to the printing unit in accordance with the power supply condition detected by the detecting means.

In another aspect of the invention, there is provided an image forming device for use in combination with an external device, the image forming device including a printing unit, a printer base, a detection means, and means for stopping a power supply. The printing unit normally performs an image forming operation by a primary power source installed in the external device. The printing unit has a box shaped configuration. The printer base includes a base section and a feeder section. The base section includes an auxiliary power source unit connectable to the printing unit and supplies power to the printing unit instead of the primary power source when the printing unit is mounted on the base section. The feeder section is pivotally connected to the base section and includes a sheet accommodating portion for storing therein a stack of a plurality of cut sheets and a sheet supplying mechanism that supplies each one of the sheets of the sheet stack in the sheet accommodating portion toward the printing unit. The feeder section is foldable onto the base section. The detecting means detects a power supply condition of at least one of the primary power source and the auxiliary power source. The stopping means is adapted for stopping power supply from the primary power source to the printing unit in accordance with the power supply condition detected by the detecting means.

DETAILED DESCRIPTION OF THE PREFERRED EMBODIMENTS

An image forming device according to a first embodiment of the present invention will be described with reference to FIGS. 1 through 5. The first embodiment pertains to an ink jet printer.

Figure 1:
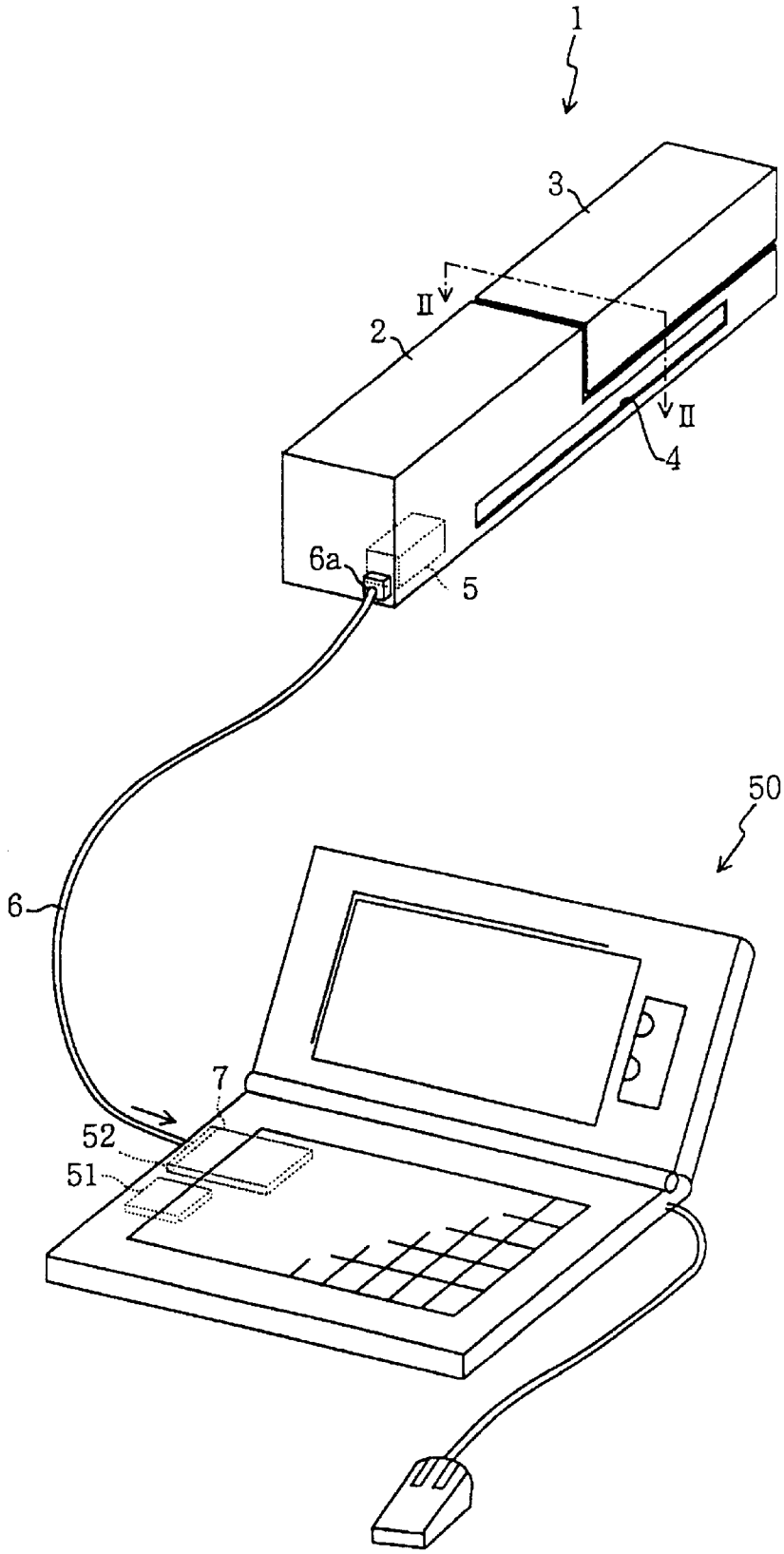
FIG. 1 is a perspective view showing a connection between an ink jet printer according to a first embodiment of the present invention and a personal computer which is a host device.

As shown in FIG. 1, an ink jet printer 1 is electrically connected to a host device such as a personal computer 50 (hereinafter simply referred to as "PC"). The ink jet printer 1 is generally a box shape, and includes a main body 2, and a printer cartridge 3 provided detachably at an upper right portion of the main body 2. The main body 2 has a rear wall formed with a rectangular insertion slot 4 extending in a horizontal direction and at a position below the printer cartridge 3 for inserting a non-printed sheet. A box shaped auxiliary battery 5 is detachably installed in the main body 2. The auxiliary battery 5 can supply 3V as a maximum auxiliary voltage. If the power of the auxiliary battery 5 is lowered, a new auxiliary battery 5 can be replaced by the old battery. This is advantageous in outdoor use where no AC power source is provided. Any kind of battery such as a rechargeable battery and non-rechargeable battery is available as the battery 5. A connection cable 6 is provided for connecting the printer 1 to the PC 50. The connection cable 6 has one end provided with a connector 6*a* detachably engaged with a receptacle (PCMCIA connector) 2*a* (FIG. 3) provided at a left end of the main body 2. The connection cable 6 has another end provided with a PCMCIA card 7.

The PC.50 is formed with a slot 52 at a left side of the PC body. Further, a PC battery 51 is installed in the PC body and at a position in front of the slot 52 for supplying electrical power to the PC 50. The PC battery 51 can supply 5 volts at maximum and is a rechargeable battery. Alternatively, a non-rechargeable battery can be used as the PC battery 51. The PC battery 51 is electrically connected to the slot 52. The PCMCIA card 7 is detachably inserted into the slot 52 as indicated by an arrow in FIG. 1, so that print data output from the PC 50 are transmitted to the printer 1. Further, the card 7 is also adapted to supply electric power of the battery 51 to the ink jet printer 1.

Figure 2:
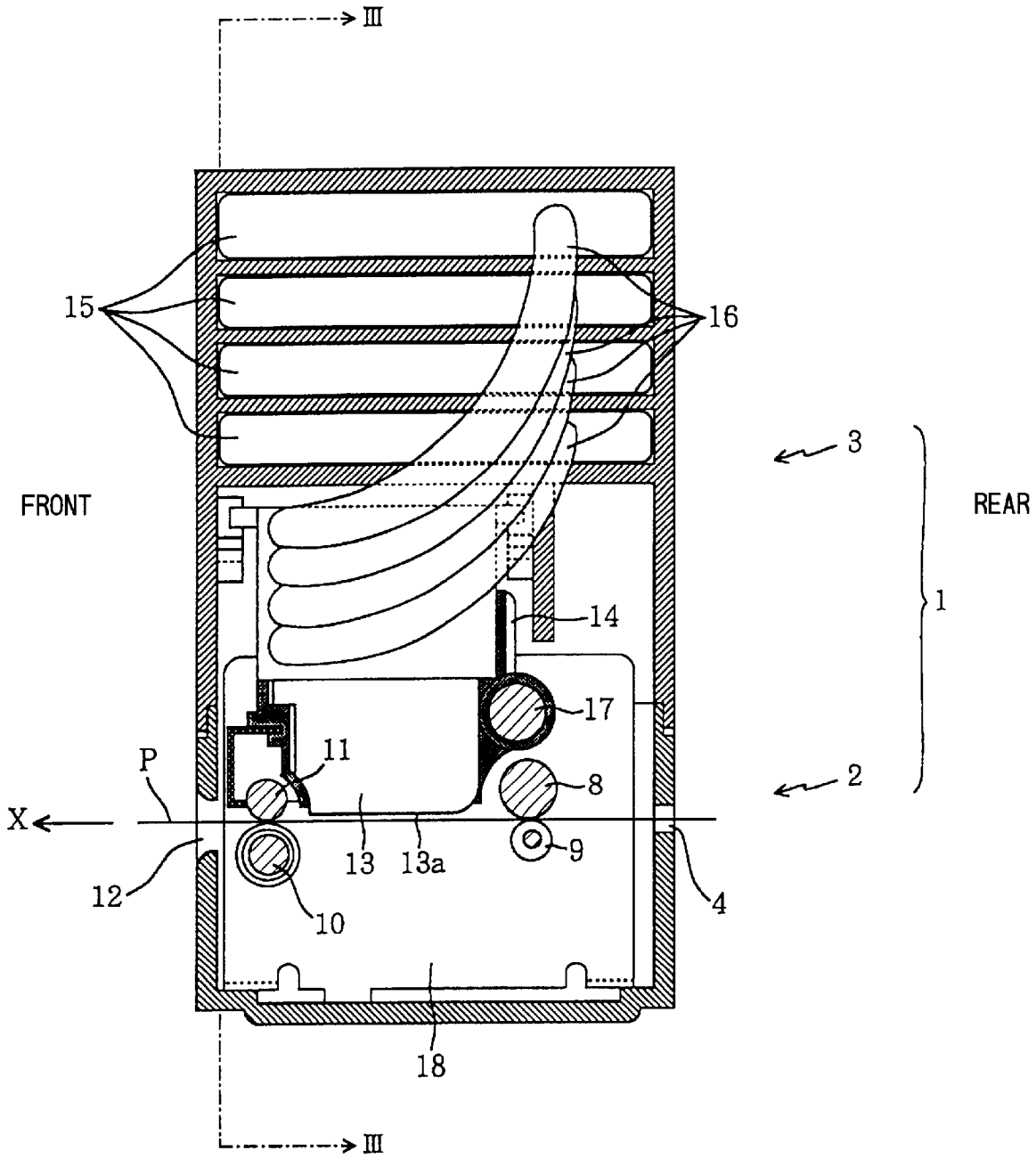
FIG. 2 is a cross-sectional view taken along the line II—II of FIG. 1 for schematically showing an internal arrangement of the ink jet printer.

As shown in FIG. 2, a sheet P runs from the rear side to the front side of the main body 2 as indicated by an arrow X. That is, the rear wall is formed with the above described insertion slot 4, and a front wall of the main body 2 is formed with a discharge slot 12 at a position in opposition to the insertion slot 4. Along the sheet passage, a feed roller 8 and a pressure roller 9 in nipping relation to the feed roller 8 are provided immediately downstream of the insertion slot 4. Further, a discharge roller 10 and a pressure roller 11 in nipping relation thereto are disposed downstream of the feed roller 8.

Figure 3:
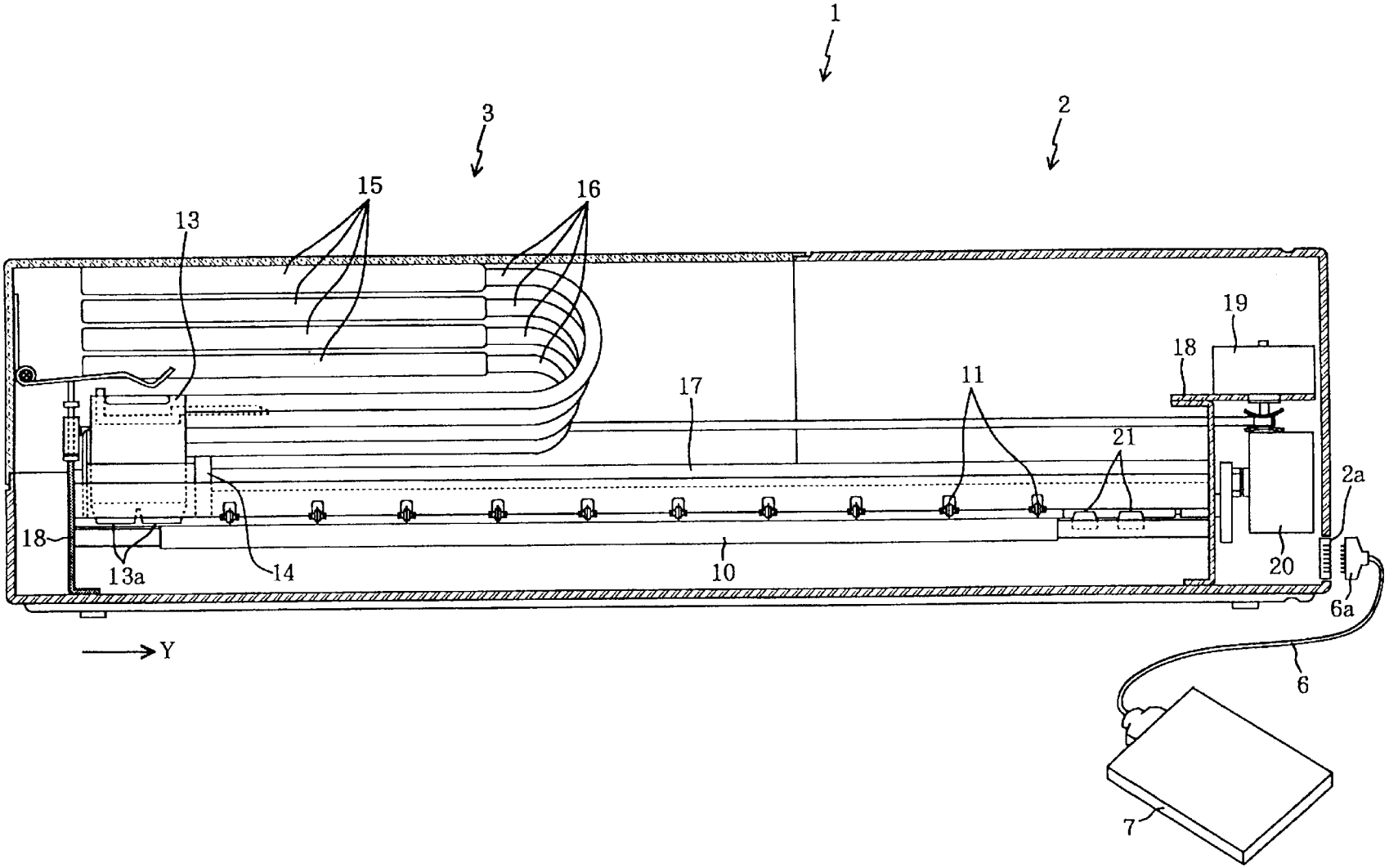
FIG. 3 is a front view as viewed from an arrow III—III of FIG. 2 for schematically showing an internal arrangement of the ink jet printer.

A print head 13 is provided at a position immediately above the sheet P and between the feed roller 8 and the discharge roller 10. The print head 13 is detachably mounted on a carriage 14, and is provided with a plurality of nozzles 13*a* through which ink is ejected toward the printing sheet P nipped between the feed roller 8 and the pressure roller 9. As shown in FIGS. 2 and 3, the main body 2 has a pair of right and left frames 18 between which a guide bar 17 extending in a horizontal direction is fixed. The carriage 14 is reciprocally movable along the guide bar 17, i.e., movable in a direction indicated by an arrow Y and opposite the arrow Y.

At a position above the print head 13, four ink cartridges 15 are detachably mounted on the printer cartridge 3 in a stacked fashion. The cartridges 15 respectively contain, inks of black, yellow, cyan and magenta in the order of from the top to the bottom. Each cartridge 15 is connected to each one end of a flexible ink supply tube 16. Each. another end of the ink supply tube 16 is connected to an upper portion of the print head 13. Thus, each of the ink cartridges 15, which is stationarily provided, is in fluid communication with the print head 13, which is movably provided, through each flexible ink supply tube 16.

As shown in FIG. 3, a carriage motor (CR motor) 19 is fixed on a top of the right frame 18 for moving the carriage 14 in the lateral direction along the guide bar 17. Further, a line feed motor (LF motor) 20 is provided to the right frame 18 and below the CR motor 19 for rotating the feed roller 8 and the discharge roller 10. At an immediately left side of the LF motor 20, a protection cap 21 is provided for covering or capping a surface area of the nozzles 13*a* in order to avoid drying of ink when the ink jet printer 1 is at its standby state where the print head 13 is moved to the rightmost stroke end.

The ink jet printer 1 receives electric power from the PC 50 by way of the PCMCIA card 7 and the connection cable 6. Further, a selected color of ink is supplied from the selected ink cartridge 15 to the print head 13 in accordance with the print data transmitted from the PC 50 to the printer 1 by way of the PCMCIA card 7 and the connection cable 6. Thus, the ink is ejected through each nozzle 13*a* onto the sheet P to form a desired inked image.

Figure 4:
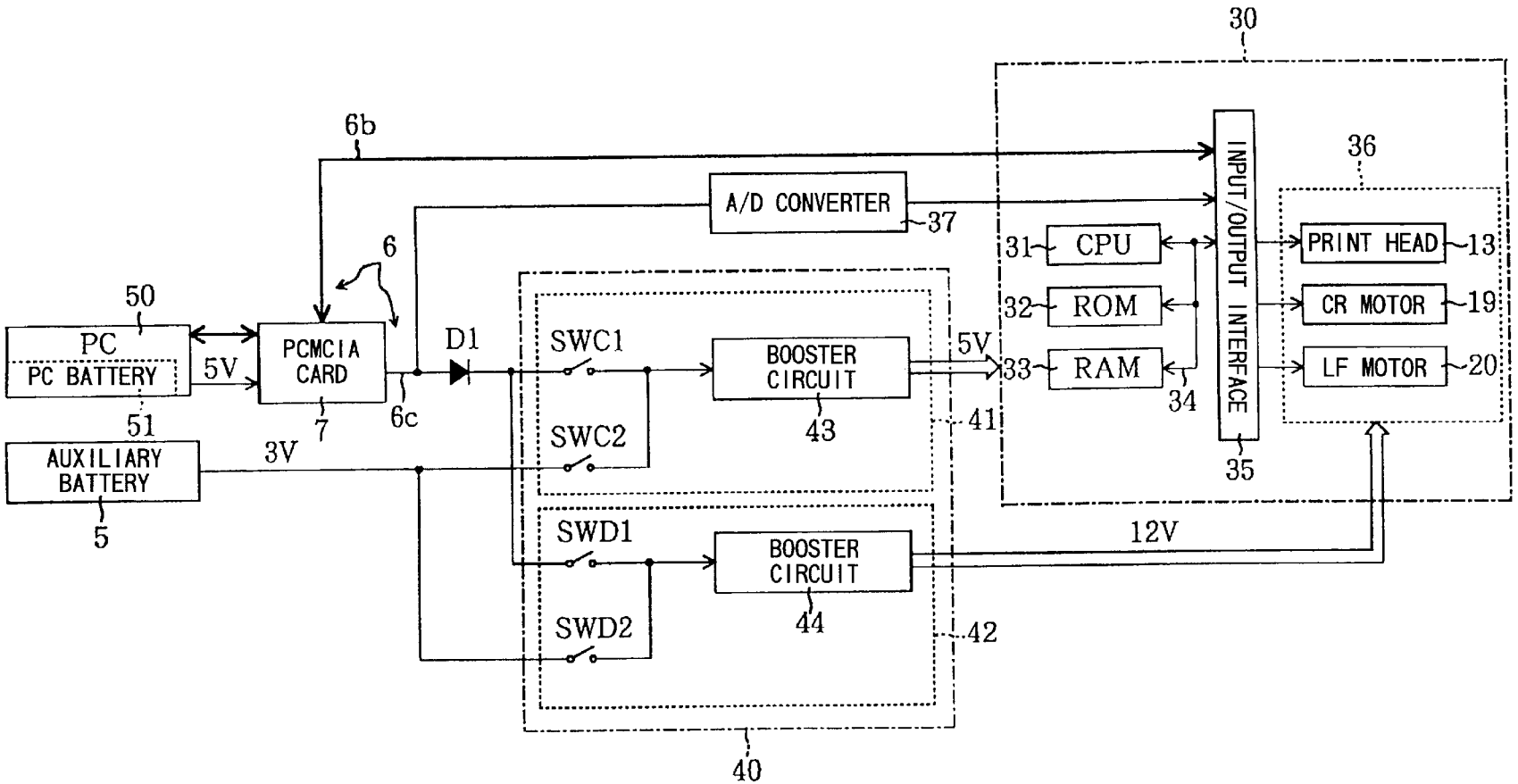
FIG. 4 is a block diagram showing an electrical arrangement of the ink jet printer according to the first embodiment.

Next, an electrical arrangement according to the first embodiment will be described with reference to FIG. 4. The ink jet printer 1 includes a control portion 30 and a power feed changeover unit 40. The control portion 30 includes a CPU 31, ROM 32 storing therein data and various control programs to be executed in the CPU 31, and a RAM 33 serving as a memory for storing print data and control signals transmitted from the PC 50 connected to the printer 1. The CPU 31, the ROM 32 and the RAM 33 are connected to one another by a bus line 34 which is connected to an input/output interface 35. The input/output interface 35 is connected to a driving portion 36 including the above-described print head 13, the CR motor 19 and the LF motor 20. Accordingly, the CPU 31 can drive the driving portion 36 to perform printing on the sheet P.

The CPU 31 is adapted to develop the print data transmitted from the PC 50 into data with which the print head 13 can perform printing, and to output the printable data, as an ejection signal for each nozzle 13*a,* to the print head 13 via the input/output interface 35. The print head 13 is driven in accordance with the ejection signal, so that ink is ejected from each nozzle 13*a* onto the printing sheet P. Further, the CR motor 19 and the LF motor 20 are driven in synchronism with the ejection signal transmitted to the print head 13.

The connection cable 6 is also connected to the input/output interface 35. The connection cable 6 includes a signal line 6*b* for transmitting the print data and a control signal from the PC 50, and a power feed line 6*c* for transmitting electric power from the battery 51 of the PC 50 to the control portion 30 and the driving portion 36. Since the signal line 6*b* is electrically connected between the input/output interface 35 and the PCMCIA card 7, the print data and the control signal output from the PC 50 can be transmitted to the CPU 31 via the input/output interface 35. Further, the power feed changeover unit 40 and the PCMCIA card 7 are connected to each other by the power feed line 6*c*. Accordingly, the electric power from the PC battery 51 can be supplied to the power feed changeover unit 40.

The input/output interface 35 is also connected to an A/D converter 37 which is connected to the power feeder line 6*c*. The A/D converter 37 converts an analog voltage level input from the PC battery into the power feed changeover unit 40 into a digital numerical data, and transmits the converted numerical data into the input/output interface 35. That is, after the PCMCIA card 7 is inserted into the card slot 52 of the PC 50 as shown in FIG. 1, and the PC 50 is turned ON, the voltage having an analog value from the PC battery 51 is supplied into the A/D converter 37 via the power feed line 6*c*. This analog value is converted into the digital numerical data in the A/D converter 37, and the digital data is transmitted into the CPU 31 through the input/output interface 35. The numerical data input in the CPU 31 are used for making judgment as to whether or not the voltage level of the PC battery 51 is not more than a predetermined voltage level, for example 3 volts, during the power supply changeover processing, described later, executed by the CPU 31.

The power feed changeover unit 40 includes a first changeover unit 41 for changing over the power supply to the control portion 30 from the PC battery 51 to the auxiliary battery 5. In other words, the first changeover unit 41 is adapted to switch a source of power to the control portion 30 from the PC battery 51 to the auxiliary battery 5. The power feed changeover unit 40 also includes a second changeover unit 42 for changing over the power supply to the driving portion 36 from the PC battery 51 to the auxiliary battery 5. In other words, by the second changeover unit 42, the driving portion 36 is supplied with a power from the auxiliary battery 5 instead of from the PC battery 51. The power feed changeover unit 40 is connected to the PCMCIA card 7 via the power. feed line 6*c* in which a diode D1 is provided. The diode D1 is adapted for preventing a reflex current from being flowed into the PC battery 51, the reflex current being generated by a counter electromotive force occurring at the power feed changeover operation at the power feed changeover unit 40.

The first changeover unit 41 includes first changeover switch SWC1, a second changeover switch SWC2, and a booster circuit 43. The first changeover switch SWC1 is connected to the diode D1 and is adapted for turning ON or OFF the supplied voltage from the PC battery 51 to the booster circuit 43. The second changeover switch SWC2 is connected to the auxiliary battery 5 and is adapted for turning ON or OFF the supplied auxiliary voltage from the auxiliary battery 5 to the booster circuit 43. The changeover operation of these changeover switches SWC1 and SWC2 is performed by the operation of the CPU 31 in accordance with a flowchart shown in FIG. 5. Further, these switches SWC1 and SWC2 are provided by a conventional transistor circuit. Incidentally, the later mentioned third and fourth changeover switches SWD1 and SWD2 are subjected to changeover operation by the execution of the CPU 31 in accordance with the flowchart of FIG. 5, and these switches are also provided by the conventional transistor circuit.

The booster circuit 43 increases the voltage supplied from the PC battery 51 or from the auxiliary battery 5 up to 5 volts which voltage. is supplied to the control portion 30 for driving the same.

The second changeover unit 42 includes the third changeover switch SWD1, the fourth changeover switch SWD2, and a second booster circuit 44. The third changeover switch SWD1 is connected to the diode D1 and is adapted for turning ON or OFF the supplied voltage from the PC battery 51 to the second booster circuit 44. The fourth changeover switch SWD2 is connected to the auxiliary battery 5 and is adapted for turning ON or OFF the supplied auxiliary voltage from the auxiliary battery 5 to the second booster circuit 44. The second booster circuit 44 increases the voltage supplied from the PC battery 51 or from the auxiliary battery 5 up to 12 volts which voltage is supplied to the driving portion 36 for driving the print head 13, the CR motor 19 and the LF motor 20.

Figure 5:
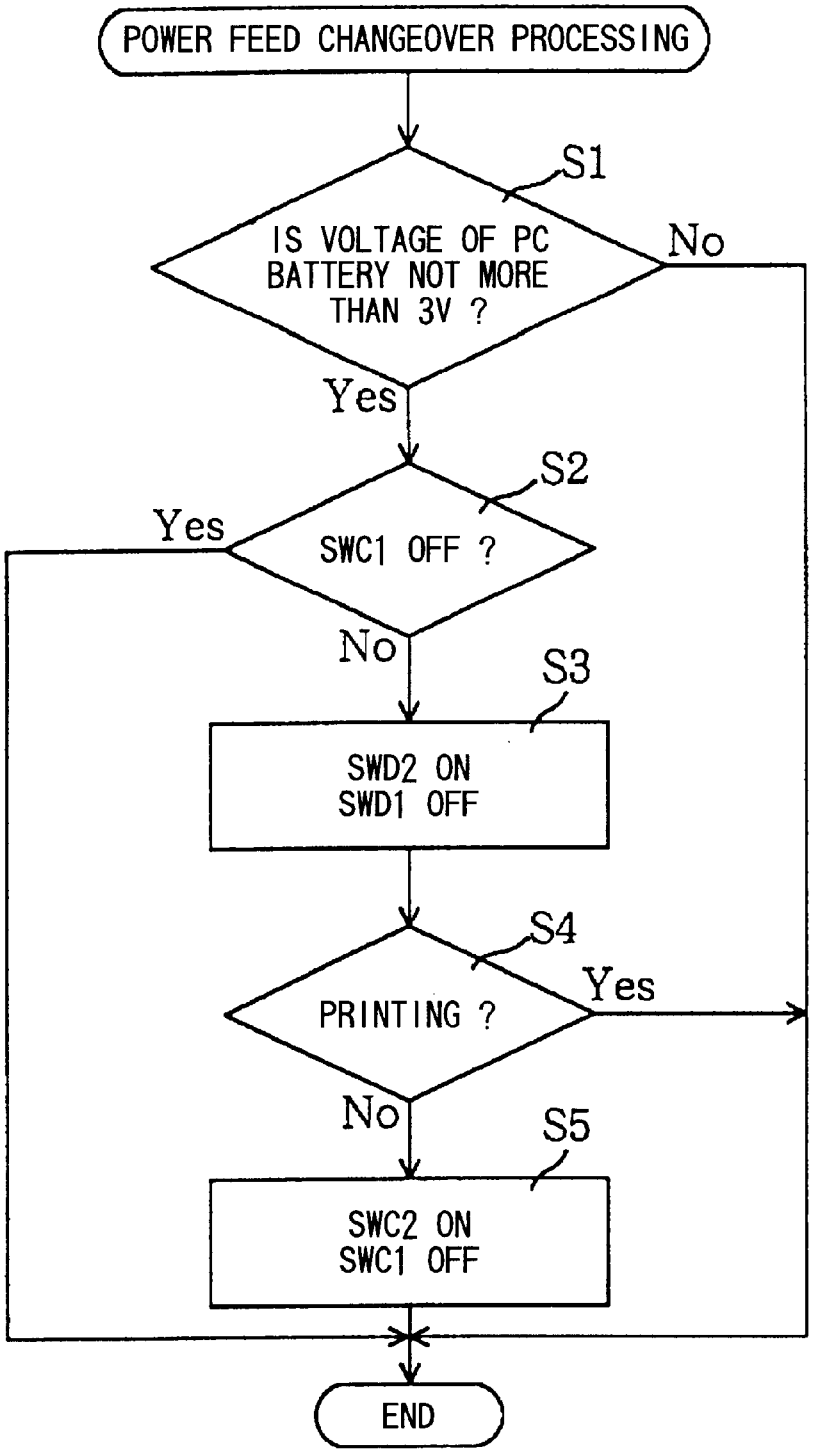
FIG. 5 is a flowchart showing an electrical power supply change-over processing.

Next, power supply changeover processing will be described with reference to the flowchart of FIG. 5. The changeover operation is performed for supplying electrical power to the ink jet printer from either the PC battery 51 or the auxiliary battery 5. This processing pertains to the changeover operation between the PC battery 51 and the auxiliary battery 5, and the processing is of an interruption processing executed periodically at every 2 ms.

When the PC 50 is turned ON after the PCMCIA card 7 is inserted into the card slot 52 of the PC 50, the voltage from the PC battery 51 is input into the A/D converter through the power feed line 6*c*. The analog value of the supplied voltage input into the A/D converter is converted into the digital numerical data, and the numerical data are transmitted to the CPU 31 through the input/output interface 35.

In the power feed changeover processing, first, judgment is made as to whether or not the numerical data input in the CPU 31 is not more than a specific value which corresponds to 3V (S1). If the voltage level of the PC battery exceeds 3V (S1:No), the routine goes into an end, because the PC battery 51 can provide sufficient power supply to the ink jet printer 1. Accordingly, the ink jet printer 1 is driven by the power supplied from the PC battery 51 provided that the latter has the voltage level more than 3V.

On the other hand in the step S1, if the numerical data input in the CPU 31 is not more than the specific value which corresponds to 3V (S1 Yes), judgment is made whether or not the first changeover switch SWC1 is in the OFF state. If the first changeover switch SWC1 is in the OFF state (S2:Yes), the routine jumps to the end assuming that the later mentioned steps S3 through S5 have been terminated. If the first changeover switch SWC1 is in the ON state (S2:No), the fourth changeover switch SWD2 is switched to the ON state and then the third changeover switch SWD1 is switched to the turned OFF state (S3). As a result, the second booster circuit 44 is disconnected from the PC battery 51 and is then connected to the auxiliary battery 5. Because the driving portion 36 requires greater power consumption than the control portion 30, the switching from the PC battery 51 to the auxiliary battery 5 is advantageous for reducing power consumption to the PC battery 51 thereby avoiding a system disruption of the PC 50.

After the step S3, the routine goes into S4 where judgment is made as to whether or not printing operation is performed. If performed (S4:Yes), the routine goes to the end. Accordingly, if the voltage level from the PC battery 51 is not more than 3V (S1:Yes) during printing operation, the power supply source to the driving portion 36 is changed from the PC battery 51 to the auxiliary battery 5 enabling the printing operation, whereas the power supply source to the control portion 30 is still the PC battery 51. In other words, changeover operation between the first and second changeover switches SWC1 and SWC2 is not performed during the printing operation. As a result, electrical noise due to the changeover operation is not generated, so that the control portion 30 does not receive such noise to avoid erroneous printing or missing printing.

In the step S4, if the printing is completed (S4:No), the second changeover switch SWC2 is turned ON, and then the first changeover switch SWC1 is turned OFF (S5), and the routine is ended. Accordingly, the first booster circuit 43 is disconnected from the PC battery 51, but is then connected to the auxiliary battery 5, and therefore, the power source to the control portion 30 is switched from the PC battery 51 to the auxiliary battery 5. This changeover operation may generate electrical noise. However, disadvantageous phenomena such as erroneous printing and blank do not occur, since this changeover process (S5) is performed after completion of the printing operation (S4).

In the ink jet printer 1 supplied with electrical power in a manner described above, print data and control signal are transmitted into the printer 1 via the PCMCIA card 7 inserted into the card slot 52. After the input of these data and the control signal, and if a printing sheet P is inserted into the insertion slot 4, the sheet P is fed to a position immediately below the print head 13 by the rotation of the feed roller 8 driven by the LF motor 20 and the pressure roller 9. Then, printing is performed by the ink ejection from the nozzle 13*a* of the print head 13 mounted on the carriage 14 driven by the CR motor 19. The printed sheet P is discharged through the discharge slot 12 by the rotation of the discharge roller 10 driven by the LF motor 20 and the pressure roller 11.

An ink jet printer 100 according to a second embodiment of the present invention will next be described with reference to FIGS. 6 through 11. In the second embodiment, instead of the auxiliary battery 5 of the first embodiment, a power source unit 151 is provided as a supplemental power source in a printer base 150. In FIGS. 6 through 11, like parts and components are designated by the same reference numerals and characters as those shown in FIGS. 1 through 5 to avoid duplicate description.

Figure 6:
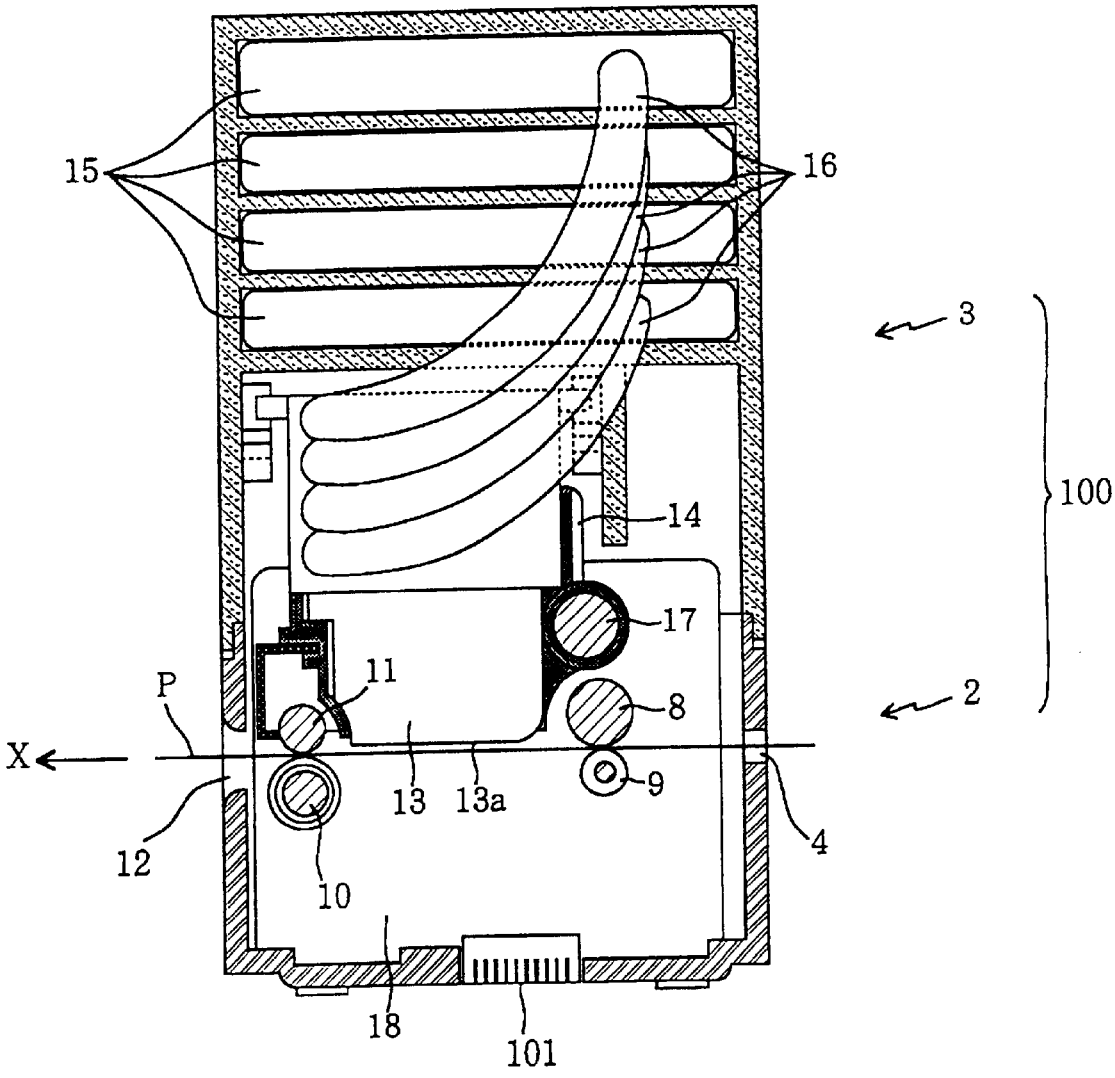
FIG. 6 is a cross-sectional view schematically showing an internal arrangement of an ink jet printer according to a second embodiment of the present invention.

As shown in FIG. 6, a connector 101 is provided at a position below the print head 13, i.e. at a bottom wall of a main body 2. The connector 101 is connected to a connector 154 (FIG. 7) of the power supply unit 151 (FIG. 7) so that electrical power can be supplied from the power supply unit 151 to the ink jet printer 100.

Figure 7:
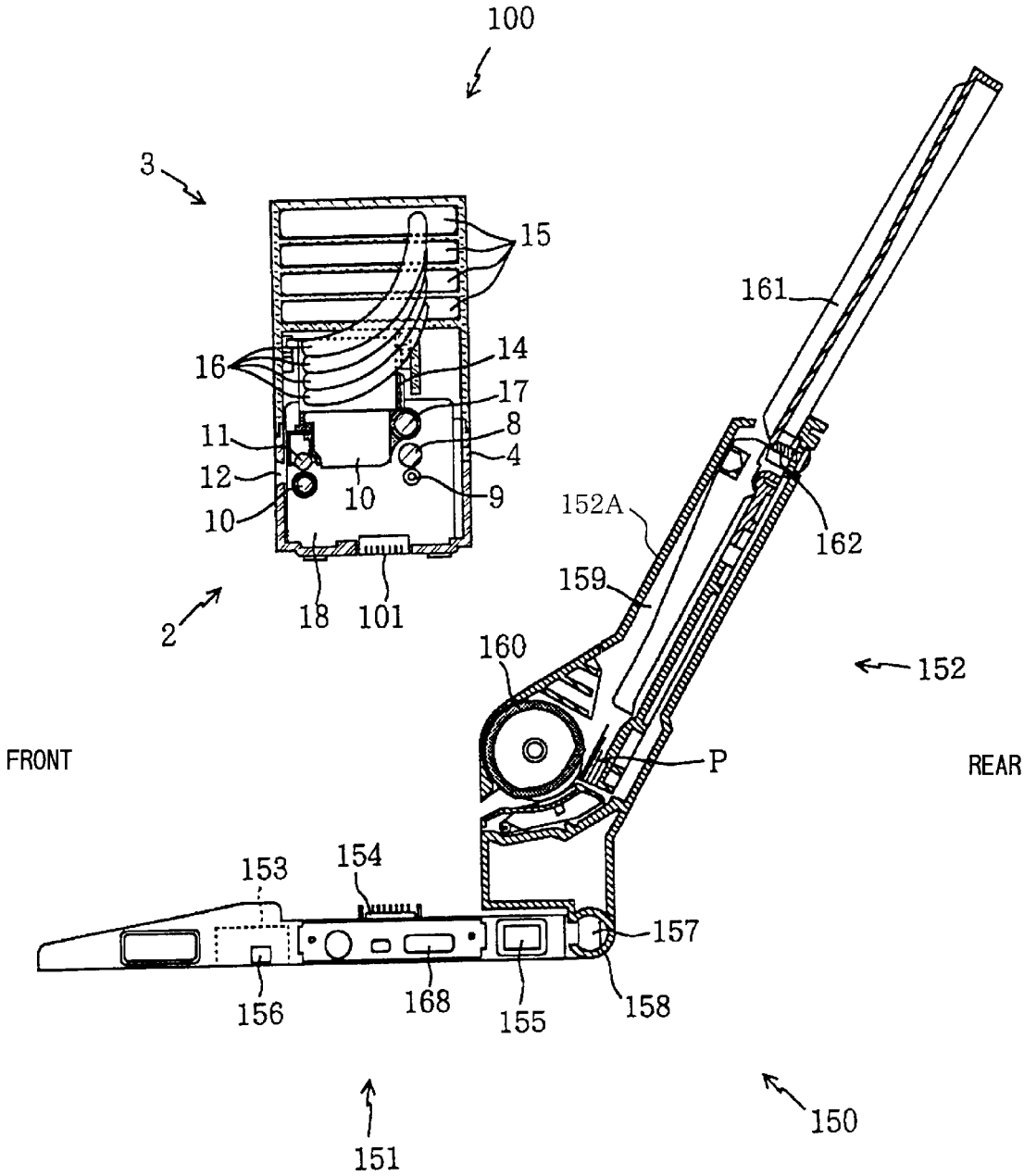
FIG. 7 is a cross-sectional side view showing the ink jet printer according to the second embodiment and a printer base on which the ink jet printer is detachably mounted.
Figure 8:
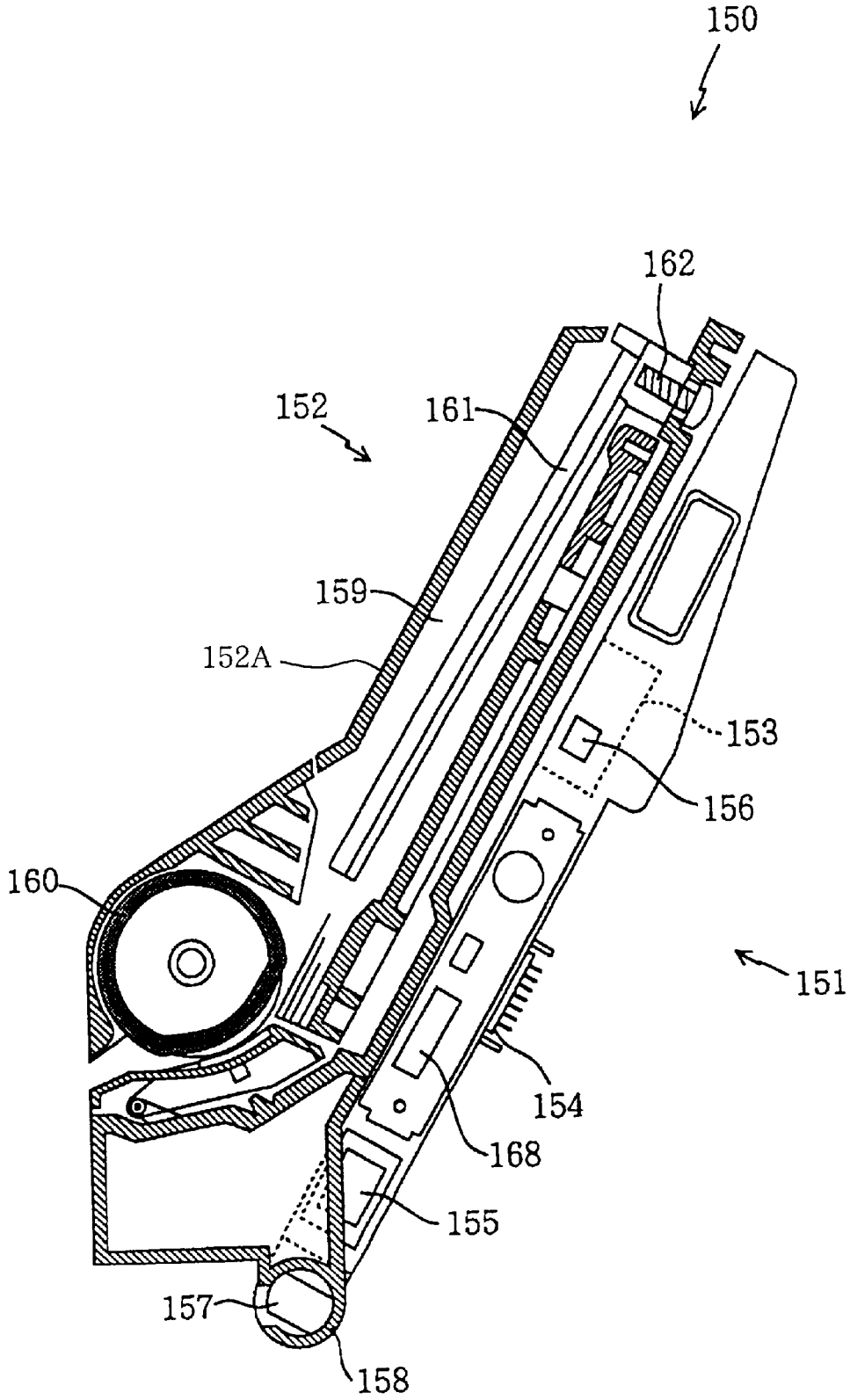
FIG. 8 is a cross-sectional side view showing a folded state of the printer base of FIG. 7.

FIG. 7 shows the printer base 150 and the ink jet printer 100 to be mounted thereon. The ink jet printer 100 is detachably mounted on the printer base 150. The printer base 150 serves as an automatic cut-sheet feeder, hereinafter simply referred to as "ACF", as well as as an electrical power source to the ink jet printer 100 when the ink jet printer 100 is mounted on the printer base 150 for performing a great number of printing in an indoor spot.

Figure 10:
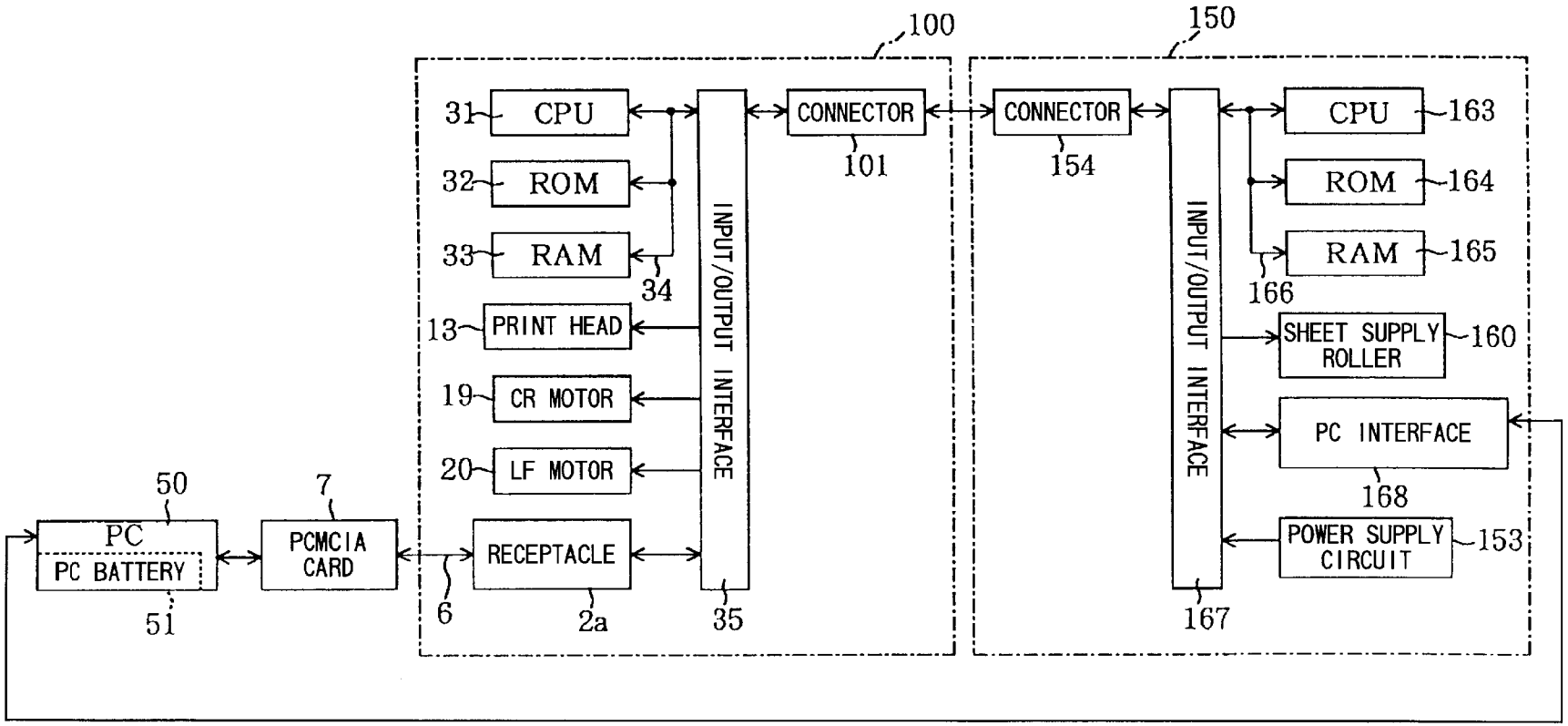
FIG. 10 is a block diagram showing an electrical arrangement of the ink jet printer according to the second embodiment.

The printer base 150 includes the power source unit 151 serving as a power source to the ink jet printer 100, and feeder unit 152 for supplying each one of the cut sheet P to the ink jet printer 100. The power source unit 151 has a generally plate like configuration and accommodates therein a power supply circuit 153. The connector 154 is provided at an upper surface of the power supply unit 151 and is electrically connected to the power supply circuit 153 (FIG. 10). When the ink jet printer 100 is mounted on the top surface of the power supply unit 151 to connect the connector 101 to the connector 154, electrical power can be supplied from the power supply unit 151 to the ink jet printer 100.

At a side wall of the power supply unit 151, an ON/OFF switch 155 is provided for turning ON or OFF the power supply unit 151. Further, an end portion of an PC interface 168 is provided at the side wall. The PC interface 168 is of a Centronix type for connecting the host device such as the PC 50. Furthermore, beside the ON/OFF switch, a connector 156 is provided which is connected to an AC adapter (not shown) which supplies electric power to the power supply circuit 153. The AC adapter is connected to an AC outlet in a known manner. As a modification, instead of the power supply circuit 153, a large capacity rechargeable battery can be installed in the power supply unit 151.

The power source unit 151 is pivotally connected to the feeder unit 152. To this effect, a support shaft 157 is provided at a rear side of the power supply unit 151, and a hinge 158 is provided at a lower end of the feeder unit 152. The support shaft 157 is provided rotatably with respect to the hinge 158. Therefore, the power source unit 151 is pivotally movable in a counterclockwise direction relative to the feeder unit 152 from a state shown in FIG. 7 to a state shown in FIG. 8 where a lower surface of the power supply unit 151 is brought into abutment with a rear surface of the feeder unit 152. Thus, the printer base 150 can be folded into a compact size which can be easily installed in a bag or a case to enhance portability.

The feeder unit 152 has a feeder frame 152A in which a sheet accommodating portion 159 is provided for accommodating a plurality of cut sheets in a stacked manner. A sheet supply roller 160 is rotatably provided within the feeder frame 152A and at the lower portion of the sheet accommodating portion 159 for supplying each one of the cut-sheet to the insertion slot 4 of the ink jet printer 100. Accordingly, a great numbers of cut sheets can be successively and automatically supplied to the ink jet printer 100 without any manually sheet inserting operation.

An extension guide 161 is provided at an upper portion of the feeder frame 152A. The extension guide 161 has a plate shape and is pivotally supported to the upper portion of the feeder frame 152A by a support screw 162, so that the extension guide 161 can provide an extending position shown in FIG. 9 and a retracted position shown in FIG. 8. In the extending position, the extension guide 161 extends upwardly from the upper end of the sheet accommodating portion 159 for supporting upper end portion of the sheets P. In the retracted position, the extension guide 161 is positioned in the sheet accommodating portion 159 to make the entire size compact during transportation.

An electrical arrangement of the ink jet printer 100 and the printer base 150 according to the second embodiment is shown in FIG. 10. To an input/output interface 35 of the ink jet printer 100 are connected the CPU 31, the ROM 32, the RAM 33, the print head 13, the connector 101, the CR motor 19, the LF motor 20 and the connector 2*a*. The connector 2*a* is connected to the PCMCIA card 7 via the cable 6 and the connector 6*a* as shown in FIG. 1 or 3. The PCMCIA card 7 is connected to the PC 50. Therefore, print data etc. output from the PC 50 are retrieved in the CPU 31 through the input/output interface 35, and are subjected to processing in accordance with a program stored in the ROM 32. Further, electrical power supplied from the PC battery 51 of the PC 50 is supplied to the CR motor 19, and the LF motor 20 etc. via the input/output interface 35 for performing printing operation, if the ink jet printer 100 is separated from the printer base 150.

The printer base 150 includes a CPU 163, a ROM 164 storing therein various data and programs executed by the CPU 163, and RAM 165 serving as a memory for storing therein print data and etc. transmitted form the PC 50. The CPU 163, the ROM 164, the RAM 165 are connected together by a bus line 166.

The bus line 166 is also connected to an input/output interface 167 to which the power supply circuit 153, the connector 154, the sheet supply roller 160 and the PC interface 168 are connected. The power supply circuit 153 supplies electrical power to the ink jet printer 100 through the input/output interface 167, the connector 154 and the connector 101 when the ink jet printer 100 is mounted on the printer base 150 and the connector 101 is connected to the connector 154. The power supply circuit 153 also supplies electrical power to the sheet supply roller 160 for driving the same.

The CPU 163 is adapted for transmitting driving signals to the sheet supply roller 160 through the input/output interface 167, so that the sheet supply roller 160 can supply a sheet P to the ink jet printer 100 in synchronism with the CR motor 19 and the LF motor 20. The print data output from the PC 50 are transmitted through the PC interface 168 into the CPU 31 and processed therein and are input into the print head 13 to perform printing on the sheet P.

Even if the connector 101 of the printer 100 is not connected to the connector 154 of the printer base 150, that is, even if the ink jet printer 100 is separated from the printer base 150, printing operation can still be performed by a connection between the PC 50 and the ink jet printer 100 with the PCMCIA connector 2*a*. On the other hand, if the connector 101 is connected to the connector 154, the connection between the PC 50 and the ink jet printer 100 by the PCMCIA connector 2*a* can be shut off, and instead, the PC 50 is connected to the printer base 150 via the PC interface 168 for operating the printer 100.

Figure 11:
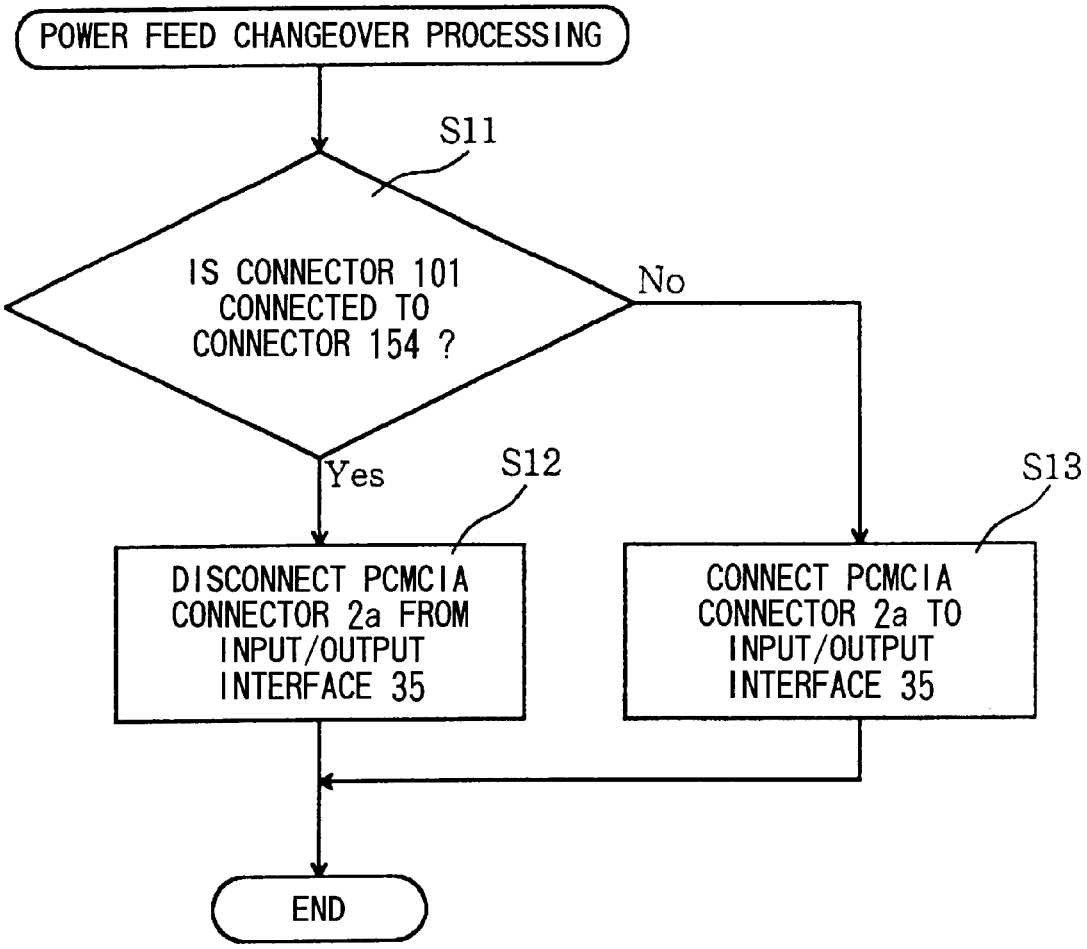
FIG. 11 is a flowchart showing an electrical power supply change-over processing according to the second embodiment.

Next, power feed changeover processing to the ink jet printer 100 will be described with reference to a flowchart shown in FIG. 11. According to this processing, first, judgment is made as to whether or not the connector 101 of the ink jet printer 100 is connected to the connector 154 of the power source unit 151 (S11). If the connectors 101 and 154 are connected to, each other (S11:Yes), the PCMCIA connector 2*a* of the ink jet printer 100 is electrically shut off from the input/output interface 35 (S12). As a result, electrical power supply from the PC battery 51 to the ink jet printer 100 is suspended, and instead, the electrical power is supplied to the ink jet printer 100 from the power supply circuit 153 of the printer base 150, and the processing is ended.

On the other hand, if the connector 101 is not connected to the connector 154 (S11:No), the PCMCIA connector 2*a* is brought into electrical connection to the input/output interface 35 (S13). As a result, the electrical power is supplied to the ink jet printer 100 from the PC battery 51.

With this processing, even if the ink jet printer 100 is connected to the PC 50 via the PCMCIA connector 2*a* and the cable 6, electrical power consumption of the PC battery 51 due to the driving of the ink jet printer 100 can be restrained, because the electrical connection between the PCMCIA connector 2*a* and the input/output interface 35 is automatically shut off in S12. Consequently, a system down of the PC 50 can be prevented.

Next, printing operation will be described. As shown in FIG. 7, if the ink jet printer 100 is to be used without the printer base 150, the connector 6*a* of the cable 6 is connected to the PCMCIA connector 2*a* of the ink jet printer 100. Then, the PCMCIA card 7 connected to the cable 6 is inserted into the card slot 52 of the PC 50. Thus, the ink jet printer 100 is electrically connected to the PC 50. Accordingly, the electrical power from the PC battery 51 can be supplied to the ink jet printer 100 for driving the latter. In this connection, printing can be performed outdoors by carrying together the ink jet printer 100 and the PC 50.

Figure 9:
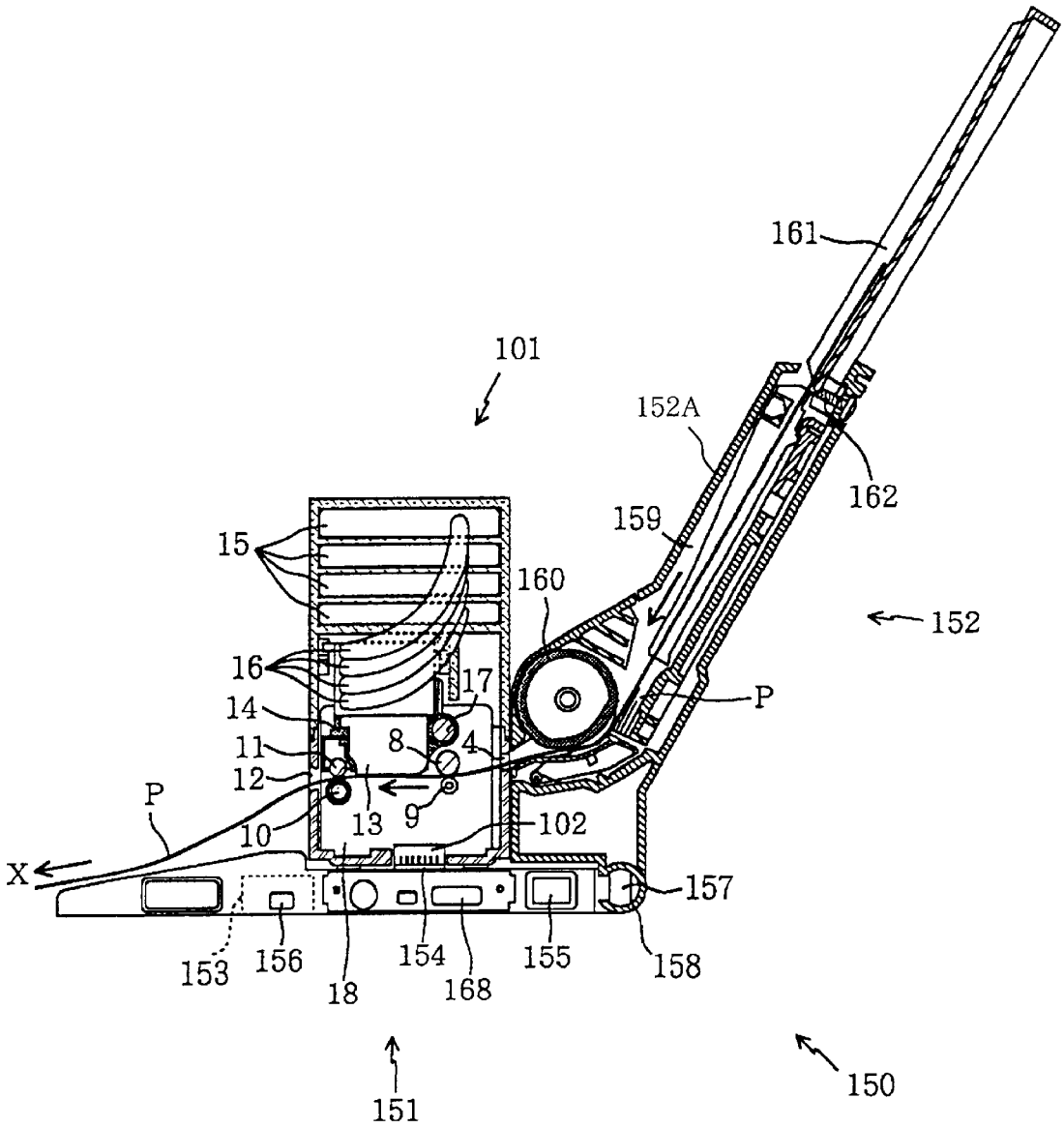
FIG. 9 is a cross-sectional view showing the printer base and the ink jet printer mounted thereon.

As shown in FIG. 9, if the printer 100 and the printer base 150 are to be used, the connector 101 of the printer 100 is electrically connected to the connector 154 of the power source unit 150 when the printer 100 is mounted on the power source unit 151 with an upstanding posture of the feeder unit 152. Therefore, power supply from the power supply circuit 153 is made to the ink jet printer 100. Then, if each one sheet P of the sheet stack on the sheet accommodating portion 159 is fed by the sheet supply roller 160 into the insertion slot 4 of the ink jet printer 100, the sheet P is further fed in the direction indicated by the arrow X in FIG. 9 toward the position below the print head 13 by the rotation of the feed roller 8 driven by the LF motor 20 and the pressure roller 9. When the sheet P passes the print head 13, ink is ejected onto the sheet P from the nozzles 13*a* of the print head 13 mounted on the carriage 14 driven by the CR motor 19. Thus, an inked image is formed on the sheet P. The printed sheet P is then discharged through the discharge slot 12 by the rotation of the discharge roller 10 driven by the LF motor 20 and the pressure roller 11.

Therefore, a large numbers of printings can be performed indoors with the employment of the printer base 150 provided with the feeder unit 152. In this case, the power source of the ink jet printer 100 and the feeder unit 152 is not the PC battery 51 but the power source unit 151 including the power supply circuit 153. Consequently, abrupt power consumption of the PC battery 51 can be avoided to obviate a system-down of the PC 50 and break down of a hard disc installed in the PC 50.

While the invention has been described in detail and with reference to the specific embodiments thereof, it would be apparent to those skilled in the art that various changes and modifications may be made therein without departing from the spirit and scope of the invention.

For example, in the first embodiment, if the voltage level of the PC battery 51 is lowered to a predetermined voltage, for example, becomes not more than 3V, power source to the ink jet printer 100 is changed from the PC battery 51 to the auxiliary battery 5 installed in the ink jet printer 100. However, the predetermined voltage level can be altered to other level in accordance with the consumed power of the PC.

Further, in the first embodiment, instead of the switching of the power source, the auxiliary battery 5 of the ink jet printer can perform supplemental electrical power supply to the PC 50, if the voltage level of the PC battery 51 is lowered to a predetermined voltage. Further, in the first embodiment, the ink jet printer 1 is electrically connected to the PC 50 through the PCMCIA card 7, and power source to the ink jet printer 1 is changed from the PC battery 51 to the auxiliary battery 5 if the power level of the PC battery 51 is lowered. As a modification, the auxiliary battery 5 can serve as a main power source to the ink jet printer 1, and the power supply from the PC battery 51 to the printer is only performed via the PCMCIA card 7 if the power level of the auxiliary battery 5 is lowered.

In the first embodiment, instead of the steps S2 through S5 where the power source to the ink jet printer 1 is changed from the PC battery 51 to the auxiliary battery 5 if the judgment in the step S1 falls Yes, printing process performed in the printer can be immediately stopped to render the printer to be its standby state in order to avoid the system-down of the PC 50. In the latter case, the carriage 14 mounting the print head 13 is moved to the position in confrontation with the protection cap 21 so as to cover the nozzle 13*a* with the cap 21, and is then, printing process is stopped. As a result, solidification of the ink within the nozzle 13*a* can be avoided.

Further, in the second embodiment, the PC battery 51 is a rechargeable battery. However, a non-rechargeable battery such as a dry battery can be used. Further, in the second embodiment, instead of the PC battery 51, a power source unit can be used. In the latter case, an AC adapter connectable to an AC outlet is used, and the AC adapter is connected to the power source unit. Accordingly, electrical power can be supplied to the ink jet printer 100 and to the printer base 150 from the power source unit of the PC 50, and consequently, it is unnecessary to connect an additional AC adapter to the connector 156 of the printer base 150. The power source unit of the PC 50 can supply electrical power to the ink jet printer 100 and to the printer base 150. Therefore, it is unnecessary to carry the additional AC adapter for the printer base 150 when transporting the PC 50, the AC adapter for the PC 50, the ink jet printer 100 and the printer base 150. Thus, entire luggage can be reduced in size.

Further, in the second embodiment, electrical connection between the PCMCIA connector 2*a* of the ink jet printer 100 and the input/output interface 167 is shut off (S12) if the connector 101 of the printer 100 is connected to the connector 154 of the power source unit 151 (S11:Yes). However, instead of the step S12, the steps S3 through S5 in the first embodiment are available if the judgment in S11 falls Yes.

More specifically, in the arrangement where the PC 50 and the ink jet printer 100 is electrically connected to each other through the PCMCIA card 7 and the PCMCIA card connector 2*a,* and the ink jet printer 100 and the printer base 150 are connected to each other through the connectors 101 and 154, print data to the ink jet printer 100 (to the CPU 31) is transmitted via the PCMCIA card 7 and the connector 2*a,* whereas power source to the ink jet printer 100, that is, to the CR motor 19 and the LF motor 20, is switched from the PC battery 51 to the power source circuit 153 on the printer base 150 through the connectors 101, 154 and the input/output interface 167. After the printing is completed, the power source to the CPU 31 etc. is switched from the PC battery 51 to the power source circuit 153. (If this switching is performed during printing operation, noise may be generated at the switching timing, which may cause erroneous printing). The CPU 31 exclusively performs print data processing even after the connection between the CPU 31 and the power source circuit 153.

Further, in the second embodiment, the auxiliary battery 5 used in the first embodiment can be installed in the printer 100. In the latter case, a secondary battery can be used as the auxiliary battery 5, and the auxiliary battery 5 can be recharged through the cable 6 and the PCMCIA card 7 when the PC battery 51 of the PC 50 is recharged through the AC adapter connected to the AC outlet. Recharging of the auxiliary battery must be started after power in the auxiliary battery 5 must be used up, otherwise degradation of the auxiliary battery may occur. However, if the auxiliary. battery 5 is supplied with the electrical power from the PC battery 51 through the PCMCIA card 7 in a state where the PC 50 is driven by the PC battery 51 and electrical power is not supplied to the PC battery 51 by the AC adapter, power consumption of the PC battery 51 is accelerated, and the system-down of the PC 50 may occur. A modification can be conceivable to avoid this problem. According to the modification, if the PC 50 is not connected with the AC adapter, the PC 50 and/or the printer 1 or 100 can display the disconnecting state, and the recharging of the auxiliary battery 5 from the PC battery 51 is prohibited. If the PC is connected with the AC adapter, the PC 50 and/or the printer 1 or 100 can display this connecting state, and the user can perform a predetermined operation to the printer 1 or 100 and the PC 50 to restart the recharging of the auxiliary battery 5.

What is claimed is:

1. An image forming device for use in combination with an external device, the image forming device comprising:

a printing unit that normally performs an image forming operation by a primary power source installed in the external device;

an auxiliary power source unit connectable to the printing unit for supplying power to the printing unit instead of the primary power source;

detecting means that detects a power supply condition of at least one of the primary power source and the auxiliary power source unit;

means for stopping power supply from the primary power source to the printing unit in accordance with the power supply condition detected by the detecting means, wherein the power supply condition is a voltage level of the primary power source, the detecting means detecting the voltage level of the primary power source; and wherein the stopping means stops power supply from the primary power source to the printing unit if the voltage level detected by the detecting means is lower than a predetermined voltage level, the printing unit comprising:

a print head that forms an image on a printing sheet;

driving means for driving the print head; and control means for processing printing data and controlling the driving means; and wherein the stopping means further comprises a switching means that switches a power connection to the driving means from the primary power source to the auxiliary power source unit if the detection means detects the voltage level lower than the predetermined voltage level during a printing operation, wherein the switching means comprises means for maintaining the power connection between the primary power source and the control means during the printing operation even if the detection means detects the voltage level lower than the predetermined voltage level.

2. The image forming device as claimed in claim 1, wherein the switching means further comprises means for changing-over the power connection to the control means from the primary power source to the auxiliary power source unit after the printing operation is terminated, if the detection means detects the voltage level lower than the predetermined voltage level during the printing operation.

3. The image forming device as claimed in claim 2, wherein the auxiliary power source unit is detachably installed in the printing unit.

4. The image forming device as claimed in claim 2, wherein the auxiliary power source unit comprises a battery.

5. An image forming device for use in combination with an external device, the image forming device comprising:

a printing unit that normally performs an image forming operation by a primary power source installed in the external device, the printing unit being provided independent of the external device;

an auxiliary power source unit connectable to the printing unit for supplying power to the printing unit instead of the primary power source;

detecting means that detects a power supply condition of at least one of the primary power source and the auxiliary power source unit;

means for stopping power supply from the primary power source to the printing unit in accordance with the power supply condition detected by the detecting means; and a printer base having the auxiliary power source unit, the printer unit being detachably mounted on the printer base, wherein the printing unit comprises:

a first connector to be connected to the primary power source to allow power supply from the primary power source to the printing unit; and a second connector electrically connectable to the auxiliary power source unit, wherein the power supply condition is an electrical connection or disconnection between the second connector and the auxiliary power source unit, the detecting means detecting the connection or disconnection, and wherein the stopping means shuts off electrical connection between the first connector and the primary power source if the detection means detects the connection between the second connector and the auxiliary power source unit.

6. The image forming device as claimed in claim 5, wherein the auxiliary power source unit is connectable to an AC power source.

7. The image forming device as claimed in claim 5, wherein the second connector is electrically connected to the auxiliary power source unit when the printing unit is mounted on the printer base.

8. The image forming device as claimed in claim 7, wherein the printer base comprises:

a base section in which the auxiliary power source unit is accommodated; and a feeder unit connected to the base section.

9. The image forming device as claimed in claim 5, wherein the printing unit further comprises:

a print head that forms an image on a printing sheet;

driving means for driving the print head; and control means for processing printing data and controlling the driving means.

10. The image forming device as claimed in claim 9, wherein the stopping means comprises switching means that switches a power connection to the driving means from the primary power source to the auxiliary power source unit if the detection means detects the electrical connection between the second connector and the auxiliary power source unit during a printing operation.

11. An image forming device for use in combination with an external device, the image forming device comprising:

a printing unit that normally performs an image forming operation by a primary power source installed in the external device;

an auxiliary power source unit connectable to the printing unit for supplying power to the printing unit instead of the primary power source;

detecting means that detects a power supply condition of at least one of the primary power source and the auxiliary power source unit;

means for stopping power supply from the primary power source to the printing unit in accordance with the power supply condition detected by the detecting means; and a printer base having the auxiliary power source unit, the printer unit being detachably mounted on the printer base, wherein the printing unit comprises:

a first connector to be connected to the primary power source to allow power supply from the primary power source to the printing unit; and a second connector electrically connectable to the auxiliary power source unit, wherein the power supply condition is an electrical connection or disconnection between the second connector and the auxiliary power source unit, the detecting means detecting the connection or disconnection, wherein the stopping means shuts off electrical connection between the first connector and the primary power source if the detection means detects the connection between the second connector and the auxiliary power source unit, wherein the second connector is electrically connected to the auxiliary power source unit when the printing unit is mounted on the printer base, wherein the printer base comprises:

a base section in which the auxiliary power source unit is accommodated; and a feeder unit connected to the base section, and wherein the feeder unit comprises a sheet accommodating portion for storing therein a stack of a plurality of cut sheets, and a sheet supplying mechanism that supplies each one of the sheets of the sheet stack in the sheet accommodating portion toward the printing unit.

12. The image forming device as claimed in claim 11, wherein the printer base further comprises a link member that pivotally and movably supports the feeder unit to the base section, the base section having a bottom surface and the feeder unit having a rear surface, and the feeder unit providing a pivotally movable range between a using position and non-using position, the rear surface being in contact with the bottom surface in the non-using position.

13. An image forming device for use in combination with an external device, the image forming device comprising:

a printing unit that normally performs an image forming operation by a primary power source installed in the external device;

an auxiliary power source unit connectable to the printing unit for supplying power to the printing unit instead of the primary power source;

detecting means that detects a power supply condition of at least one of the primary power source and the auxiliary power source unit;

means for stopping power supply from the primary power source to the printing unit in accordance with the power supply condition detected by the detecting means; and a printer base having the auxiliary power source unit, the printer unit being detachably mounted on the printer base, wherein the printing unit comprises:

a first connector to be connected to the primary power source to allow power supply from the primary power source to the printing unit;

a second connector electrically connectable to the auxiliary power source unit;

a print head that forms an image on a printing sheet;

driving means for driving the print head; and control means for processing printing data and controlling the driving means, wherein the power supply condition is an electrical connection or disconnection between the second connector and the auxiliary power source unit, the detecting means detecting the connection or disconnection, wherein the stopping means shuts off electrical connection between the first connector and the primary power source if the detection means detects the connection between the second connector and the auxiliary power source unit, wherein the stopping means comprises switching means that switches a power connection to the driving means from the primary power source to the auxiliary power source unit if the detection means detects the electrical connection between the second connector and the auxiliary power source unit during a printing operation, and wherein the switching means comprises means for maintaining the power connection between the primary power source and the control means during the printing operation even if the detection means detects the electrical connection between the second connector and the auxiliary power source unit.

14. The image forming device as claimed in claim 13, wherein the switching means further comprises means for changing-over the power connection to the control means from the primary power source to the auxiliary power source unit after the printing operation is terminated, if the detection means detects the electrical connection between the second connector and the auxiliary power source unit during the printing operation.

15. An image forming device for use in combination with an external device, the image forming device comprising:

a printing unit that normally performs an image forming operation by a primary power source installed in the external device;

an auxiliary power source unit connectable to the printing unit for supplying power to the printing unit instead of the primary power source;

detecting means that detects a power supply condition of at least one of the primary power source and the auxiliary power source unit;

means for stopping power supply from the primary power source to the printing unit in accordance with the power supply condition detected by the detecting means; and a printer base having the auxiliary power source unit, the printer unit being detachably mounted on the printer base, wherein the printing unit comprises:

a first connector to be connected to the primary power source to allow power supply from the primary power source to the printing unit; and a second connector electrically connectable to the auxiliary power source unit;

a print head that forms an image on a printing sheet;

driving means for driving the print head; and control means for processing printing data and controlling the driving means, wherein the power supply condition is an electrical connection or disconnection between the second connector and the auxiliary power source unit, the detecting means detecting the connection or disconnection, wherein the stopping means shuts off electrical connection between the first connector and the primary power source if the detection means detects the connection between the second connector and the auxiliary power source unit, and wherein the printer base comprises:

a base section in which the auxiliary power source unit is accommodated;

a feeder unit connected to the base section and comprising:

a sheet accommodating portion for storing therein a stack of a plurality of cut sheets;

a sheet supplying mechanism that supplies each one of the sheets of the sheet stack in the sheet accommodating portion toward the printing unit; and a control unit that controls the sheet supplying mechanism.

16. An image forming device for use in combination with an external device, the image forming device comprising:

a printing unit that normally performs an image forming operation by a primary power source installed in the external device, the printing unit having a box shaped configuration;

a printer base comprising:

a base section comprising an auxiliary power source unit connectable to the printing unit that supplies power to the printing unit instead of the primary power source when the printing unit is mounted on the base section; and a feeder section pivotally connected to the base section and comprising a sheet accommodating portion for storing therein a stack of a plurality of cut sheets, and a sheet supplying mechanism that supplies each one of the sheets of the sheet stack in the sheet accommodating portion toward the printing unit, the feeder section being foldable onto the base section;

detecting means that detects a power supply condition of at least one of the primary power source and the auxiliary power source unit; and means for stopping power supply from the primary power source to the printing unit in accordance with the power supply condition detected by the detecting means, wherein the printing unit comprises:

a first connector to be connected to the primary power source to allow power supply from the primary power source to the printing unit; and a second connector electrically connectable to the auxiliary power source unit;

and wherein the power supply condition is an electrical connection or disconnection between the second connector and the auxiliary power source unit, the detecting means detecting the connection or disconnection;

and wherein the stopping means shuts off electrical connection between the first connector and the primary power source if the detection means detects the connection between the second connector and the auxiliary power source unit.

17. An image forming device for use in combination with an external device installing therein a first power source, the image forming device comprising:

a second power source;

a printing unit that performs an image forming operation by an electrical power supplied from one of the first power source and the second power source and based on print data supplied from the external device, the printing unit being provided independent of the external device;

a printer base having the second power source, the printer unit being detachably mounted on the printer base;

detection means that detects a detrimental voltage supplied from the first power source, the detrimental voltage being detrimental to operation of the external device, and switching means that switches a power supplying route to the printing unit from the first power source to the second power source when the detection means detects the detrimental voltage.

18. An image forming device for use in combination with an external device installing therein a first power source, the image forming device comprising:

a second power source;

a printing unit that performs an image forming operation by an electrical power supplied from one of the first power source and the second power source;

detection means that detects a detrimental voltage supplied from the first power source, the detrimental voltage being detrimental to operation of the external device;

switching means that switches a power supplying route to the printing unit from the first power source to the second power source when the detection means detects the detrimental voltage;

judging means that makes judgment as to whether or not the printing unit is performing a printing operation; and maintaining means that prevents switching means from switching from the first power source to the second power source in spite of the detection of the detrimental voltage by the detection means, when the judgment means judges that the printing unit is performing the printing operation.

19. An image forming system, comprising:

an external device including therein a first power source;

an image forming device driven by the first power source upon connection with the external device through a first connector and performing an image forming operation based on print data supplied from the external device, the image forming device being provided independent of the external device and comprising:

a printer body;

a second connector;

a base body on which the printer body is detachably mountable;

a third connector connectable to the second connector when the printer body is mounted to the base body at a suitable position; and a second power source connected to the third connector for supplying electrical power to the image forming device instead of the first power source; and the image forming device further comprising:

detection means for detecting that the printer body is mounted on the suitable position of the base body; and control means that terminates electrical power supply from the first power source and initiates electrical power supply from the second power source when the detection means detects that the printer body is mounted on the suitable position of the base body.

20. The system as claimed in claim 19, further comprising a sheet feeder provided at the base body, the sheet feeder supplying a sheet to the image forming device.

21. An image forming system, comprising:

an external device including therein a first power source;

a base body;

a sheet feeder provided at the base body, the sheet feeder supplying a sheet to the image forming device; and an image forming device driven by the first power source upon connection with the external device through a first connector and performing an image forming operation based on print data supplied from the external device, the image forming device comprising:

a printer body;

a second connector;

a third connector connectable to the second connector when the printer body is mounted to the base body at a suitable position;

a second power source connected to the third connector for supplying electrical power to the image forming device instead of the first power source;

detection means for detecting that the printer body is mounted on the suitable position of the base body; and control means that terminates electrical power supply from the first power source and initiates electrical power supply from the second power source when the detection means detects that the printer body is mounted on the suitable position of the base body, wherein the sheet feeder is pivotally connected to the base body and is foldable onto the base body.

22. An image forming device for use in combination with an external device including therein a first power source, the image forming device comprising:

a printing unit that performs an image forming operation by an electrical power supplied from the first power source and based on print data supplied from the external device, the printing unit being provided independent of the external device;

an auxiliary power source unit connectable to the printing unit for supplying power to the printing unit instead of the primary power source;

a printer base having the auxiliary power source unit, the printer unit being detachably mounted on the printer base;

detection means that detects a detrimental voltage supplied from the first power source, the detrimental voltage being detrimental to operation of the external device; and control means that stops the image forming operation of the printing unit, when the detection means detects the detrimental voltage.

* * * * *